US007772961B2

(12) United States Patent
Kinoshita et al.

(10) Patent No.: US 7,772,961 B2
(45) Date of Patent: Aug. 10, 2010

(54) CHIP-SHAPED ELECTRONIC PART

(75) Inventors: Yasuharu Kinoshita, Fukui (JP); Toshiki Matsukawa, Fukui (JP); Naoki Shibuya, Fukui (JP); Shoji Hoshitoku, Osaka (JP)

(73) Assignee: Panasonic Corporation, Osaka (JP)

( * ) Notice: Subject to any disclaimer, the term of this patent is extended or adjusted under 35 U.S.C. 154(b) by 757 days.

(21) Appl. No.: 11/662,200

(22) PCT Filed: Sep. 9, 2005

(86) PCT No.: PCT/JP2005/016597

§ 371 (c)(1),
(2), (4) Date: Mar. 8, 2007

(87) PCT Pub. No.: WO2006/030705

PCT Pub. Date: Mar. 23, 2006

(65) Prior Publication Data

US 2008/0094169 A1 Apr. 24, 2008

(30) Foreign Application Priority Data

Sep. 15, 2004 (JP) ..... 2004-267926
Sep. 15, 2004 (JP) ..... 2004-267927

(51) Int. Cl.
*H01C 1/012* (2006.01)

(52) U.S. Cl. ..... 338/309; 338/22 R

(58) Field of Classification Search ..... 338/22 R, 338/307–309

See application file for complete search history.

(56) References Cited

U.S. PATENT DOCUMENTS 6,982,624 B2 1/2006 Saito et al.
2004/0164841 A1 8/2004 Saito et al.

(Continued)

FOREIGN PATENT DOCUMENTS

CN 1525496 9/2004

(Continued)

OTHER PUBLICATIONS

Chinese Office Action (along with English language translation) issued Apr. 10, 2009 in the Chinese Application No. 200580028870.9.

*Primary Examiner*—Kyung Lee
(74) *Attorney, Agent, or Firm*—Wenderoth, Lind & Ponack, L.L.P.

(57) ABSTRACT

A chip-shaped electronic part includes: a substrate; a pair of upper surface electrodes formed on an upper surface of the substrate; a functional element formed to be electrically connected to the upper surface electrode pair; a pair of lower surface electrodes formed on a lower surface of the substrate at positions opposing the upper surface electrode pair; a pair of end surface electrodes formed on end surfaces of the substrate so that each of the end surface electrode pair is electrically connected to one of the upper surface electrode pair, and to one of the lower surface electrode pair corresponding to the one upper surface electrode; a protective film formed in such a manner as to cover at least the functional element; and a plated layer formed in such a manner as to cover at least each of the upper surface electrode pair, wherein the protective film or the plated layer has at least two points of application at which a load from above the substrate is exerted.

2 Claims, 15 Drawing Sheets

U.S. PATENT DOCUMENTS

2006/0158304 A1 7/2006 Moriya

FOREIGN PATENT DOCUMENTS

| | | |
|---|---|---|
| JP | 7-86003 | 3/1995 |
| JP | 2535441 | 6/1996 |
| JP | 8-222404 | 8/1996 |
| JP | 2000-195701 | 7/2000 |
| JP | 2002-231502 | 8/2002 |
| JP | 2003-282304 | 10/2003 |
| JP | 2004-79811 | 3/2004 |
| WO | 2004/055836 | 7/2004 |

CHIP-SHAPED ELECTRONIC PART

TECHNICAL FIELD

The present invention relates to a chip-shaped electronic part adapted for various electronic devices.

BACKGROUND ART

Hereinafter, a conventional chip-shaped electronic part is described referring to the drawings.

FIG. 11 is a cross-sectional view of a chip resistor, as an example of the conventional chip-shaped electronic part. A substrate 1 is made of ceramics such as alumina, and has an insulation property. The thickness of the substrate 1 is decreased, as the size of the chip-shaped electronic part is decreased. For instance, a substrate 1 of a 0603 chip resistor with the outer dimensions of 0.6 mm×0.3 mm has a standard thickness of 0.2 mm, and a substrate 1 of a 0402 chip resistor with the outer dimensions of 0.4 mm×0.2 mm has a standard thickness of 0.1 mm.

A pair of upper surface electrodes 2 are formed at widthwise both ends on an upper surface of the substrate 1. The upper surface electrode pair 2 generally has a film thickness of about 8 μm. A resistive element 3 is formed on the upper surface of the substrate 1 so that both ends thereof are placed over the upper surface electrode pair 2. The resistive element 3 generally has a thickness of about 8 μm. A pre-coat glass layer 4 is formed in such a manner as to cover the resistive element 3. The pre-coat glass layer 4 generally has a thickness of about 8 μm. A protective film 6 is formed in such a manner as to cover the entirety of the resistive element 3. The protective film 6 has a thickness from 10 μm to 30 μm at a portion above the resistive element 3. Accordingly, the protective film 6 has an upwardly convex shape in cross section with respect to a middle portion thereof including its vicinity resulting from a surface tension.

A pair of lower surface electrodes 5 are formed on a lower surface of the substrate 1 at positions opposing the upper surface electrode pair 2. A pair of end surface electrodes 7 are formed on end surfaces of the substrate 1 in such a manner as to be electrically connected to the upper surface electrode pair 2 and to the lower surface electrode pair 5. A nickel plated layer 8 is formed on parts of surfaces of the upper surface electrode pair 2, surfaces of the end surface electrode pair 7, and surfaces of the lower surface electrode pair 5. A solder plated layer 9 is formed in such a manner as to cover the nickel plated layer 8. The solder plated layer 9 is formed at a position lower than the middle portion of the protective film 6.

Next, a process for manufacturing the chip resistor as an example of the conventional chip-shaped electronic part is described referring to the drawings.

FIGS. 12A through 12C, and 13A through 13C are manufacturing process diagrams on the conventional chip resistor. The manufacturing method is described referring to FIGS. 12A through 12C, and 13A through 13C.

First as shown in FIG. 12A, prepared is a sheet-like substrate 1*c* made of ceramics such as alumina and having an insulation property, in which first dividing grooves 1*a* and second dividing grooves 1*b* are formed in each of the upper surface and the lower surface of the sheet-like substrate 1*c*. A number of upper surface electrodes 2 are formed on the upper surface of the sheet-like substrate 1*c* by a screen printing method in such a manner as to bridge over the first dividing grooves 1*a*. Although not illustrated, a number of lower surface electrodes 5 are formed on the lower surface of the sheet-like substrate 1*c* in such a manner as to bridge over the first dividing grooves 1*a*.

Next, as shown in FIG. 12B, resistive elements 3 are formed on the upper surface of the sheet-like substrate 1*c* by a screen printing method in such a manner as to be partially placed over the upper surface electrodes 2. Then, pre-coat glass layers 4 are formed by a screen printing method in such a manner as to cover the resistive elements 3. Then, trimming grooves 3*a* are formed in the resistive elements 3 through the pre-coat glass layers 4 by a laser or a like device so that a total resistance of the resistive elements 3 lies within a predetermined resistance range.

Next, as shown in FIG. 12C, protective films 6 are formed by a screen printing method in such a manner as to cover the resistive elements 3.

Next, a strip-shaped substrate 1*d* as shown in FIG. 13A is formed by dividing the sheet-like substrate 1*c* along the first dividing grooves 1*a* shown in FIG. 12C. Then, end surface electrodes 7 are formed by coating on end surfaces of the strip-shaped substrate 1*d* so that the end surface electrodes 7 are electrically connected to the upper surface electrodes 2 and to the lower surface electrodes 54.

Next, pieces of substrate 1*e* as shown in FIG. 13B are formed by dividing the strip-shaped substrate 1*d* shown in FIG. 13A along the second dividing grooves 1*b*.

Lastly, as shown in FIG. 13C, a nickel plated layer 8 (not shown) is formed on parts of the surfaces of the upper surface electrodes 2, the surfaces of the lower surface electrodes 5, and the surfaces of the end surface electrodes 7, followed by forming a solder plated layer 9. Thus, the conventional chip resistor is produced.

As an example of the prior art document information pertaining to the invention of the application, there is known Japanese Unexamined Patent Publication No. Hei 7-86003 (patent document 1).

The conventional chip resistor is mounted on a printed circuit board of an electronic device by soldering the lower surface electrodes 5 of the chip resistor to electrode lands 10*b* of the printed circuit board 10*a*, as shown in FIG. 14. In the mounting, the lower surface electrodes 5 of the chip resistor are positioned to the electrode lands 10*b* of the printed circuit board 10*a*, with the upper surface of the protective film 6 being attached to a mounting nozzle 10*c* by suction. In this arrangement, a pressing force is intensively exerted on the middle portion of the protective film 6 including its vicinity, which corresponds to a protrusion on the upper surface of the chip resistor, and a large force to bend the substrate 1 is acted in combination with a repulsive force received on the lower surface electrode pair 5, which corresponds to protrusions on the lower surface of the chip resistor. Thereby, a large bending stress is exerted on the substrate 1. As a result, as shown in FIG. 15, the substrate 1 may be cracked. In particular, the substrate crack is serious, if the substrate 1 with a small thickness is used in the small-sized chip-shaped electronic part e.g. a 0603 chip resistor with the outer dimensions of 0.6 mm×0.3 mm, or a 0402 chip resistor with the outer dimensions of 0.4 mm×0.2 mm.

DISCLOSURE OF THE INVENTION

In order to solve the above-mentioned conventional disadvantages, it is an object of the invention to provide a chip-shaped electronic part that enables to suppress crack of a substrate resulting from application of a stress thereto in mounting the chip-shaped electronic part on a printed circuit board of an electronic device, using a mounting nozzle.

To accomplish the above object, a chip-shaped electronic part of the invention comprises: a substrate; a pair of upper surface electrodes formed on an upper surface of the substrate; a functional element formed to be electrically connected to the upper surface electrode pair; a pair of lower surface electrodes formed on a lower surface of the substrate at positions opposing the upper surface electrode pair; a pair of end surface electrodes formed on end surfaces of the substrate so that each of the end surface electrode pair is electrically connected to one of the upper surface electrode pair, and to one of the lower surface electrode pair corresponding to the one upper surface electrode; a protective film formed in such a manner as to cover at least the functional element; and a plated layer formed in such a manner as to cover at least each of the upper surface electrode pair, wherein the protective film or the plated layer has at least two points of application at which a load from above the substrate is exerted.

In the above arrangement, in the case where the chip-shaped electronic part is mounted on a printed circuit board of an electronic device by suction with use of a mounting nozzle, a pressing force of the mounting nozzle is distributed to at least the two points of application. Accordingly, a bending stress to be exerted to the substrate is reduced, which causes no or less substrate crack.

BEST MODE FOR CARRYING OUT THE INVENTION

Figure 1:
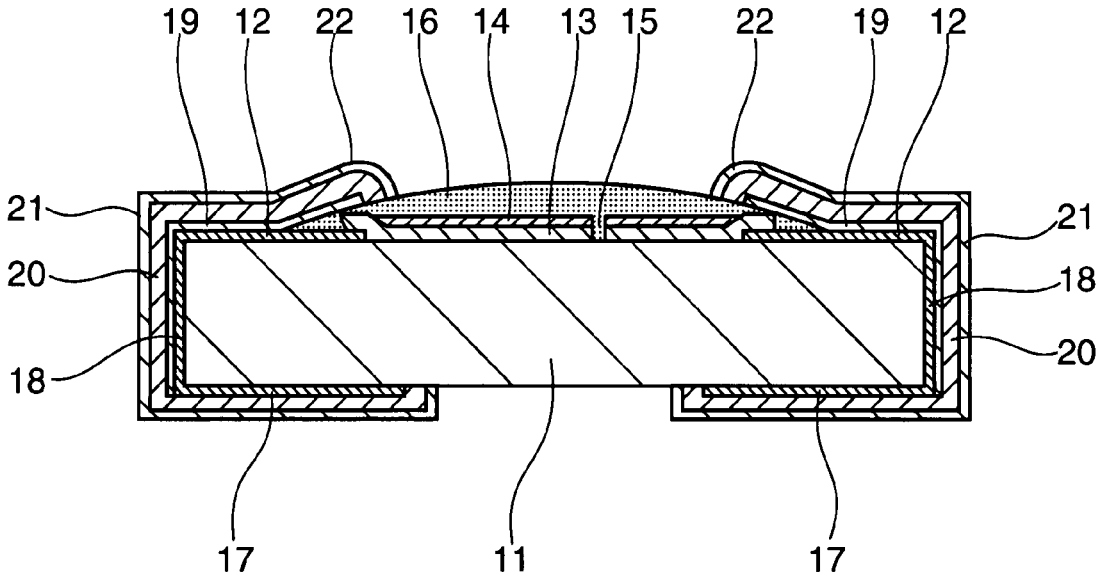
FIG. 1 is a cross-sectional view of a chip resistor, as an example of a chip-shaped electronic part according to a first embodiment of the invention.

In the following, preferred embodiments of a chip-shaped electronic part of the invention are described referring to the drawings.

First Embodiment

FIG. 1 is a cross-sectional view showing a chip resistor, as an example of a chip-shaped electronic part according to the first embodiment of the invention. A substrate 11 is made of ceramics such as fired alumina, and has an insulation property. The thickness of the substrate 11 is decreased, as the size of the chip-shaped electronic part is decreased. For instance, a substrate 11 of a 0603 chip resistor with the outer dimensions of 0.6 mm×0.3 mm has a standard thickness of 0.2 mm, and a substrate 11 of a 0402 chip resistor with the outer dimensions of 0.4 mm×0.2 mm has a standard thickness of 0.1 mm.

A pair of first upper surface electrodes 12 are formed at widthwise both ends on an upper surface of the substrate 11. The first upper surface electrode pair 12 is made of a gold resinate paste containing gold. A ruthenium-oxide-based resistive element 13 is formed on the upper surface of the substrate 11 in such a manner that both ends thereof are placed over the first upper surface electrode pair 12. A glass layer 14 is formed in such a manner as to cover at least a part of the resistive element 13. A trimming groove 15 is formed in the resistive element 13 and in the glass layer 14 to adjust the resistance of the resistive element 13 to an intended value. A protective film 16 containing an epoxy resin as a main component is formed in such a manner as to cover the resistive element 13. The protective film 16 is formed in such a manner that the widthwise both ends thereof are placed over the first upper surface electrode pair 12. The protective film 16 has a thickness of about 10 μm at a highest position from the upper surface of the substrate 11.

A pair of lower surface electrodes 17 are formed on a lower surface of the substrate 11 at positions opposing the first upper surface electrode pair 12. Each of the lower surface electrodes 17 has a substantially L-shape extending from the lower surface of the substrate 11 to a corresponding end surface of the substrate 11, which is formed by using a thin film formation technique such as sputtering. The lower surface electrode pair 17 has a double-layer structure with a first layer made of chromium, and a second layer made of copper-nickel alloy. A portion of the lower surface electrode 17 corresponding to each of the end surfaces of the substrate 11 constitutes an end surface electrode 18. An upper end portion of the lower surface electrode 17 is electrically connected to the corresponding first upper surface electrode 12. A portion of the lower surface electrode 17 at a position corresponding to the lower surface of the substrate 11 has a larger area than that of the corresponding upper surface electrode 12 in such a manner that an end portion of the lower surface electrode 17 opposing the counterpart lower surface electrode 17 extends inwardly in the widthwise direction of the substrate 11 with respect to the corresponding upper surface electrode 12.

A pair of second upper surface electrodes 19 are formed over the first upper surface electrode pair 12. Each of the second upper surface electrodes 19 has a substantially L-shape extending from the upper surface of the substrate 11 to the corresponding end surface of the substrate 11, which is formed by using a thin film formation technique such as sputtering. The second upper surface electrode pair 19 has a double-layer structure with a first layer made of chromium, and a second layer made of copper-nickel alloy. A portion of the second upper surface electrode 19 corresponding to each of the end surfaces of the substrate 11 is electrically connected to the portion of the corresponding lower surface electrode 17 which constitutes the end surface electrode 18. A portion of the second upper surface electrode 19 at a position corresponding to the upper surface of the substrate 11 is placed over the corresponding first upper surface electrode 12, and an end portion of the second upper surface electrode 19 opposing the counterpart second upper surface electrode 19 is placed over the protective film 16.

Exposed portions of the surfaces of the second upper surface electrode pair 19, the surfaces of the end surface electrode pair 18, and of the surfaces of the lower surface electrode pair 17 are covered by a pair of first plated layers 20. The first plated layer pair 20 is made of nickel, and has a thickness of about 10 μm. Surfaces of the first plated layer pair 20 are covered by a pair of second plated layers 21. The second plated layer pair 21 is made of tin, and has a thickness of about 6 μm. Thus, the second plated layer 21 has a thickness smaller than that of the first plated layer 20.

Portions of the first plated layer 20 and the second plated layer 21 which are located above the end portions of the second upper surface electrode pair 19, i.e. the end portions being placed over the protective film 16, are formed into protrusions 22 which protrude upwardly from the protective film 16. In mounting the chip resistor, the protrusions 22 come into contact with amounting nozzle. The protrusions 22 are formed into ribs which extend in a longitudinal direction of the substrate 11 i.e. a direction perpendicular to the plane of FIG. 1 at positions above the lower surface electrode pair 17. A highest point of the first plated layer 20 is set to a position higher than a highest portion of the protective film 16 by about 4 μn, and a highest point of the second plated layer 21 is set to a position higher than the highest portion of the protective film 16 by about 10 μm.

Nickel constituting the first plated layer 20 has Mohs hardness of 3.5, and tin constituting the second plated layer 21 has Mohs hardness of 1.8. The first plated layer 20 has a larger hardness than the second plated layer 21, and accordingly, is harder than the second plated layer 21. In other words, the second plated layer 21 has a smaller hardness than the first plated layer 20, and accordingly, is softer than the first plated layer 20.

Figure 5:
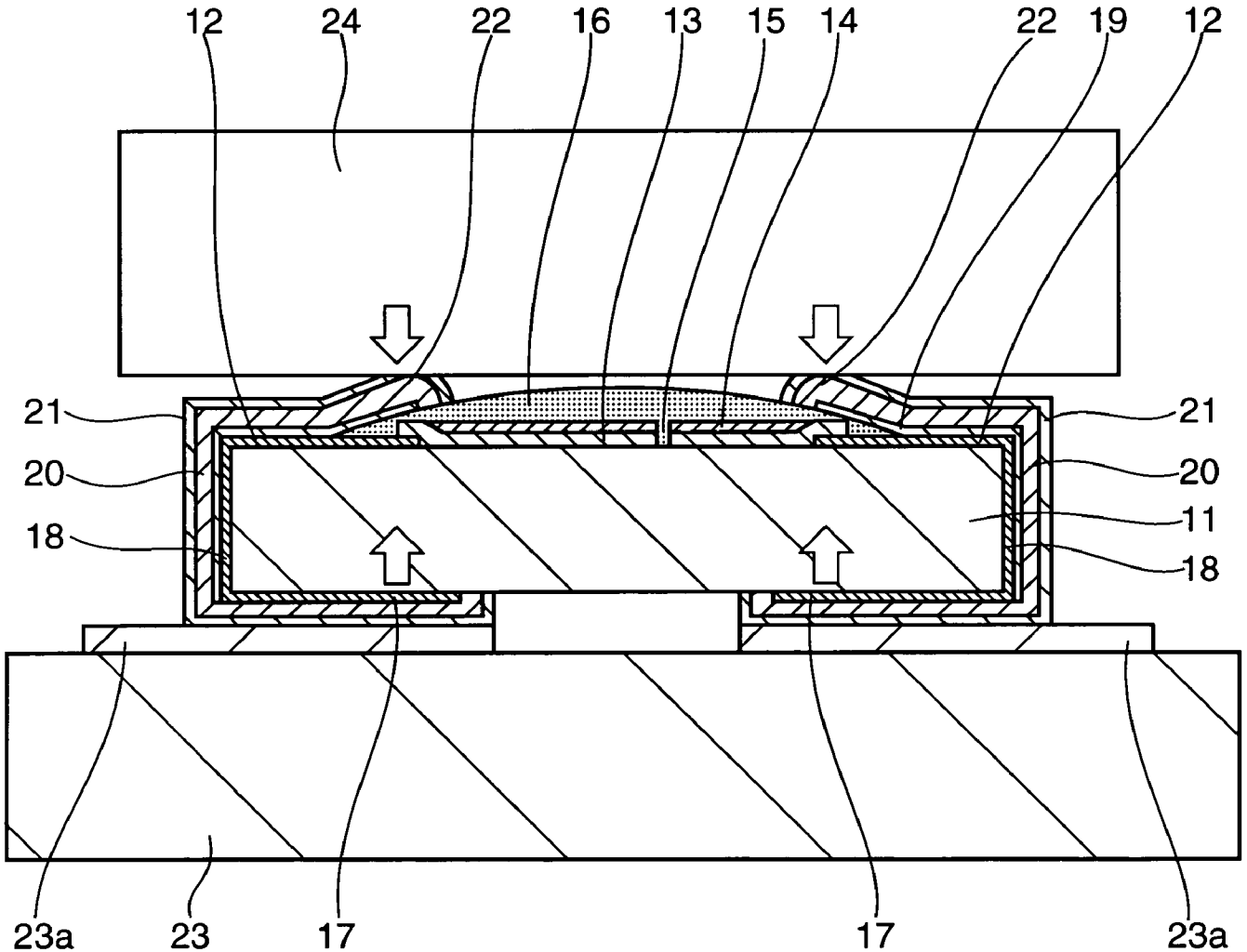
FIG. 5 is an elevational cross-sectional view showing a state that the chip resistor is mounted on a printed circuit board of an electronic device.

In the first embodiment of the invention, the plated layer structure constituted of the first plated layer 20 and the second plated layer 21 protrudes upwardly from the protective film 16. Accordingly, as shown in FIG. 5, in the case where a small-sized chip resistor with a very thin substrate such as a 0603 chip resistor with the outer dimensions of 0.6 mm×0.3 mm, or a 0402 chip resistor with the outer dimensions of 0.4 mm×0.2 mm is mounted on electrode lands 23*a* of a printed circuit board 23 of an electronic device with use of a mounting nozzle 24, the mounting nozzle 24 comes into contact with the protrusions 22. As a result, a pressing force of the mounting nozzle is received by the protrusions 22, and a bending stress to be exerted on the substrate 11 is reduced, which causes no or less substrate crack. Also, since the first plated layer 20 has a larger hardness than the second plated layer 21, and is harder than the second plated layer 21, the first plated layer 20 which has a larger hardness and is hard is capable of receiving the pressing force of the mounting nozzle 24, even if the pressing force of the mounting nozzle 24 is large, and the second plated layer 21 which has a smaller hardness and is soft is deformed at the protrusion 22. Accordingly, a force to bend the substrate 11 is not acted on the substrate 11, which is advantageous in eliminating crack of the substrate 11 at an application of a normal mounting impact.

In the first embodiment of the invention, since the second plated layer 21 at the outermost position is made of tin which is melted at a low temperature, the outermost second plated layer 21 and a low melting point metal can be easily fused in solder mounting the chip resistor on a printed circuit board 23, using the low melting point metal (such as tin-lead alloy or tin-silver-copper alloy). This enables to prevent failure in solder wettability. Also, since the first plated layer 20 made of nickel has a high melting point, and has no likelihood of being fused into an alloy during the solder mounting, the first plated layer 20 serves as a barrier layer for preventing fusion of the lower surface electrodes 17 and the end surface electrode 18 with the low melting point metal. This is advantageous in enhancing connection reliability.

Although the substrate 11 is free from a crack at an application of a normal mounting impact, the substrate 11 may be cracked when a load larger than the normal mounting impact is exerted on the substrate 11. Table 1 shows load values at which the substrates 11 are cracked under the conditions that loads are applied from above onto chip resistors with thicknesses of the first plated layer 20 and the second plated layer 21 being set to 6 μm and 10 μm, 8 μm and 8 μm, and 10 μm and 6 μm, respectively.

TABLE 1

| thickness of first plated layer | thickness of second plated layer | total thickness of first and second plated layers | load value at which substrate is cracked |
|---|---|---|---|
| 6 μm | 10 μm | 16 μm | 16N |
| 8 μm | 8 μm | 16 μm | 21N |
| 10 μm | 6 μm | 16 μm | 26N |

As is obvious from Table 1, the total thickness (sum of the thicknesses) of the first plated layer 20 and the second plated layer 21 is 16 μm in each of the chip resistors. The protruded amount of the second plated layer 21 from the protective film 16 is substantially the same under all the conditions. However, as the thickness of the first plated layer 20 is increased, a load value required for cracking the substrate 11 is increased. In view of the above, setting the thickness of the first plated layer 20 larger than the thickness of the second plated layer 21 is preferable in suppressing crack of the substrate 11 even if a pressing force of the mounting nozzle exceeds over a normal mounting impact due to some reason.

The first embodiment of the invention describes the arrangement that the first plated layer 20 protrudes upwardly from the protective film 16. As long as at least the second plated layer 21 protrudes upwardly from the protective film 16, the effect of preventing crack of the substrate 11 resulting from a pressing force of the mounting nozzle can be obtained. In this case, setting the thickness of the first plated layer 20, which has a larger hardness and is hard, larger than the thickness of the second plated layer 21, which has a smaller hardness and is soft, enables to suppress an influence of deformation of the second plated layer 21, thereby increasing the effect of preventing crack of the substrate 11.

It is desirable to set the thickness of the second plated layer 21 larger than the thickness of the protective film 16 by at least about 8 μm in average in order to obtain the effect of preventing crack of the substrate 11 in mounting, considering variation in manufacturing. In view of this, it is necessary to set the average of the total thickness of the first plated layer 20 and the second plated layer 21 to at least about 14 μm. Increasing the thickness, however, may increase the production cost. Accordingly, it is preferred to suppress the total thickness in such a range that the effect of preventing crack of the substrate 11 in mounting is obtainable. Also, decreasing the thickness of the second plated layer 21 may likely to cause failure in solder wettability. Accordingly, it is necessary to secure the thickness of at least 3 μm or more for tin plating or solder plating. Considering variation in manufacturing, it is necessary to set the thickness of the second plated layer 21 to 5 μm or more in average. Setting the thickness of the first plated layer 20 larger than the thickness of the second plated layer 21 is advantageous in suppressing crack of the substrate 11 resulting from a pressing force of the mounting nozzle. Accordingly, as the average thickness of the plated layers, it is optimal to set the thickness of the second plated layer 21 in a range from 6 μm±1 μm, and the thickness of the first plated layer 20 in a range from 10 μm±1 μm. Alternatively, considering variation in a manufacturing step, it may be preferred to set the thicknesses of the first plated layer 20, and the second plated layer 21 in a range from 10 μm±4 μm, and 6 μm±3 μm, respectively.

As described in the first embodiment of the invention, partially forming the plated layer structure constituted of the first plated layer 20 and the second plated layer 21 into the protrusions 22 enables to prevent crack of the substrate 11 while saving the material composing the first plated layer 20 and the second plated layer 21.

The first embodiment of the invention describes the arrangement that the protrusions 22 are formed into ribs. Alternatively, the protrusions 22 may be formed discretely in the longitudinal direction of the substrate 11, or may be formed at a single site, as far as the protrusions 22 project upwardly in the longitudinal direction of the substrate 11, in place of the rib form. In other words, as far as the protrusions 22 are capable of receiving the load from above the substrate 11 at least at two points away from each other in the widthwise direction of the substrate 11, any configuration of the protrusions 22 is allowed.

In the first embodiment of the invention, the protrusion pair 22 are formed substantially above the lower surface electrode pair 17, and the distance between the highest points of the protrusions 22 in the widthwise direction of the substrate 11 i.e. the distance between the points of application at which a load from above is exerted is set slightly larger than the distance between the opposing end portions of the lower surface electrode pair 17. As long as the distance between the highest points of the protrusions 22 is set to one-half or more of the distance between the opposing end portions of the lower surface electrode pair 17, the effect of the invention can be advantageously obtained. Forming the protrusion pair 22 substantially above the lower surface electrode pair 17 as described in the embodiment, however, has no or less likelihood that a bending stress may be exerted on the substrate 11, which is more advantageous in obtaining the effect of the invention.

In the following, a method for manufacturing the chip resistor, as an example of the chip-shaped electronic part according to the first embodiment of the invention is described referring to the drawings.

FIGS. 2A through 2C, 3A through 3C, and 4A through 4D are manufacturing process diagrams showing the method for manufacturing the chip resistor, as an example of the chip-shaped electronic part according to the first embodiment of the invention.

Figure 2A:
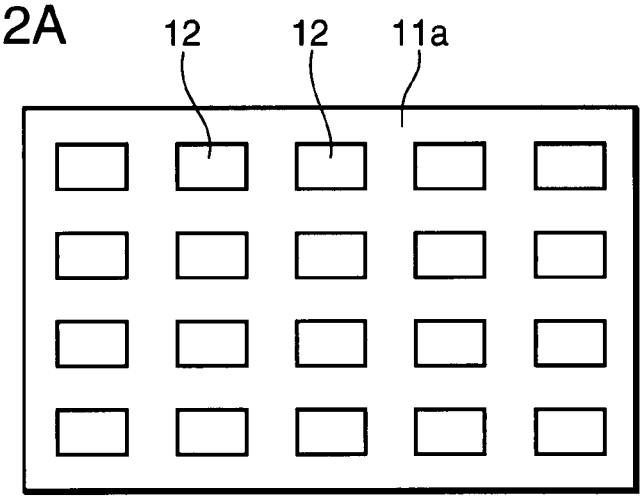
FIGS. 2A through 2C are manufacturing process diagrams showing a method for manufacturing the chip resistor in the first embodiment.

First, as shown in FIG. 2A, a sheet-like substrate 11*a* made of ceramics such as fired alumina and having an insulation property is prepared. A number of first upper surface electrodes 12 are formed in a grid pattern by screen printing a gold resinate paste containing gold on an upper surface of the sheet-like substrate 11*a*, and by firing the sheet-like substrate 11*a*, using a firing profile with a peak temperature of 850° C. In the formation of the first upper surface electrodes 12, an area without the formation of the first upper surface electrodes 12 is formed on a periphery of the sheet-like substrate 11*a*.

Figure 2B:
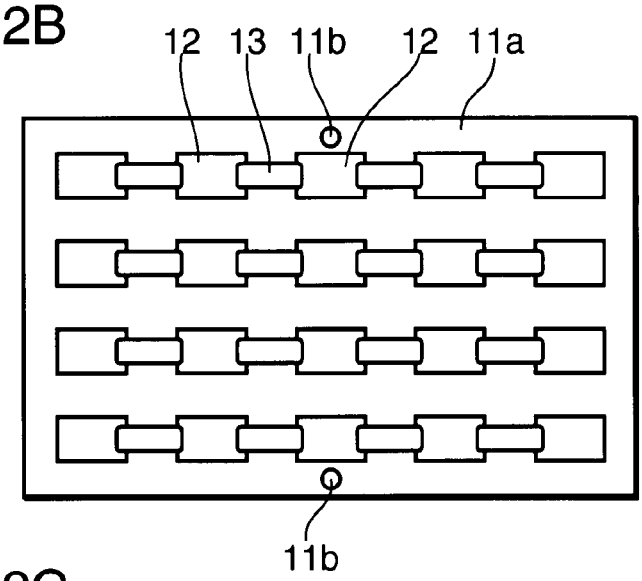

Next, as shown in FIG. 2B, a number of ruthenium-oxide-based resistive elements 13 are formed on the upper surface of the sheet-like substrate 11*a* by a screen printing method in such a manner that the resistive elements 13 are partly placed over the first upper surface electrodes 12, in other words, are electrically connected to the first upper surface electrodes 12. Thereafter, the sheet-like substrate 11*a* is fired, using a firing profile with a peak temperature of 850° C., to form the resistive elements 13 into stable films. By the formation of the resistive elements 13, the resistive elements 13 and the first upper surface electrodes 12 are connected into an array. Thus, multitudes of arrays of the resistive elements 13 and the first upper surface electrodes 12 are formed in parallel to each other. Simultaneously with the formation of the resistive elements 13, positioning marks 11*b* are formed, using the same material as the resistive elements 13.

Figure 2C:
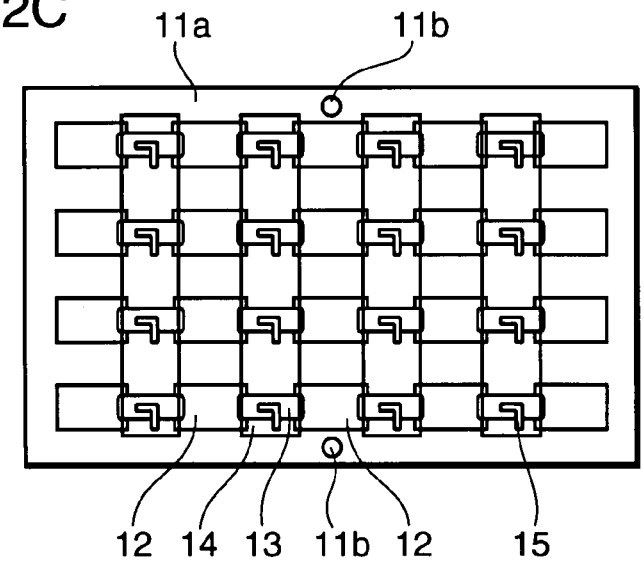

Next, as shown in FIG. 2C, glass layers 14 made of lead borate silicate are formed on the upper surface of the sheet-like substrate 11*a* by a screen printing method in such a manner as to cover the resistive elements 13 between the first upper surface electrodes 12. Thereafter, the sheet-like substrate 11*a* is fired, using a firing profile with a peak temperature of 600° C., to form the glass layers 14 into stable films. Also, trimming grooves 15 are formed in the resistive elements 13 through the glass layers 14 by a laser trimming technique to adjust the resistance of the respective resistive elements 13 between the first upper surface electrodes 12 to a constant value.

Figure 3A:
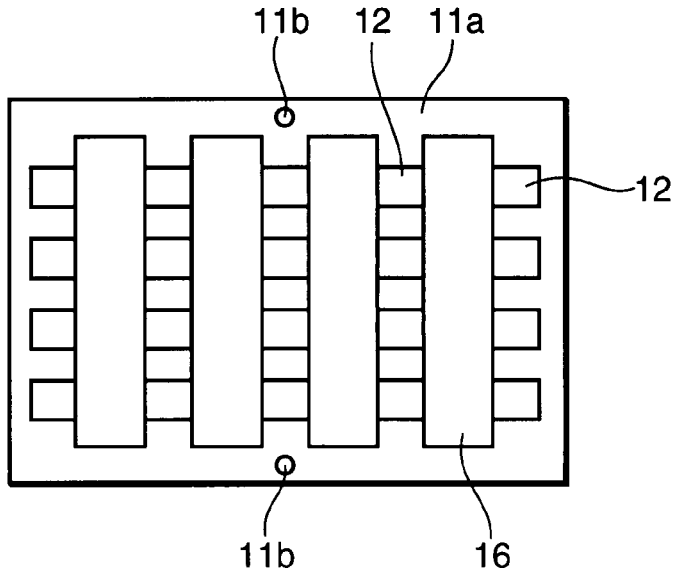
FIGS. 3A through 3C are manufacturing process diagrams showing the method for manufacturing the chip resistor in the first embodiment.

Next, as shown in FIG. 3A, protective films 16 containing an epoxy resin as a main component are formed by a screen printing method in such a manner as to cover the resistive elements 13. Thereafter, the sheet-like substrate 11*a* is cured, using a curing profile with a peak temperature of 200° C., to form the protective films 16 into stable films.

Figure 3B:
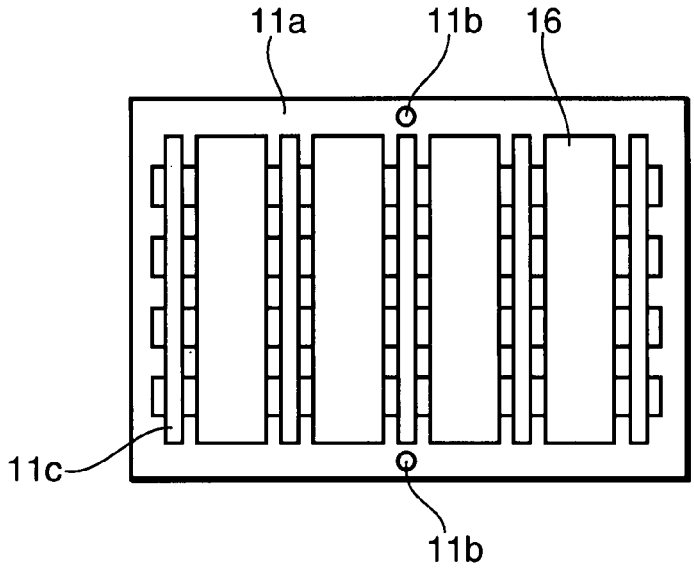

Next, as shown in FIG. 3B, the sheet-like substrate 11*a* is attached to a UV tape (not shown), with the surface having the first upper surface electrodes 12 being faced upward. Then, first slit grooves 11*c* are formed in the sheet-like substrate 11*a* in such a manner that the first upper surface electrodes 12 are cut in a direction orthogonal to the arrayed direction of the resistive elements 13 and the first upper surface electrodes 12, by a dicing technique using a high-speed rotating blade, with the positioning marks 11*b* being used as a reference. The first slit grooves 11*c* are formed, with a periphery of the sheet-like substrate 11*a* being uncut. The width of the first slit groove 11*c* is set to about 0.5 to 2 times as large as the thickness of the sheet-like substrate 11*a*.

Next, the sheet-like substrate 11*a* is peeled off from the UV tape (not shown).

Figure 3C:
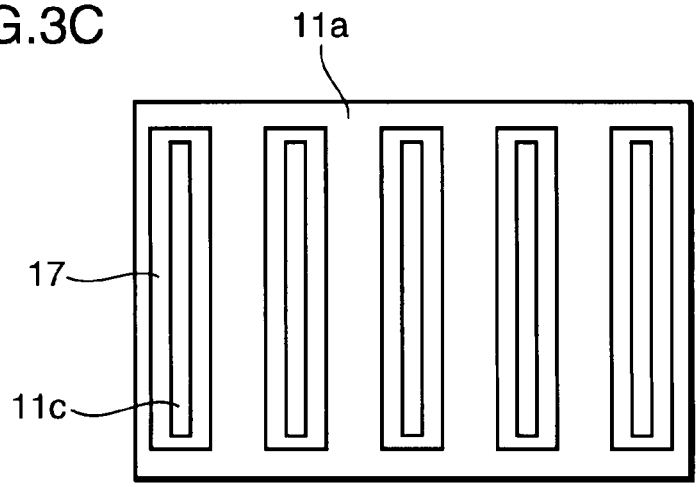

Next, as shown in FIG. 3C, lower surface electrodes 17 are formed on a part of the lower surface of the sheet-like substrate 11*a*, and wall surfaces of the first slit grooves 11*c* by performing sputtering, which is a thin film formation technique, with respect to the lower surface of the sheet-like substrate 11*a*, in a state that portions on the lower surface of the sheet-like substrate 11*a* corresponding to the portions between the first slit grooves 11*c* are masked by a metal mask (not shown). The lower surface electrodes 17 have a double-layer structure with a first layer made of chromium and a second layer made of copper-nickel alloy. Portions of the lower surface electrodes 17 corresponding to the wall surfaces of the first slit grooves 11*c* constitute end surface electrodes 18.

Figure 4A:
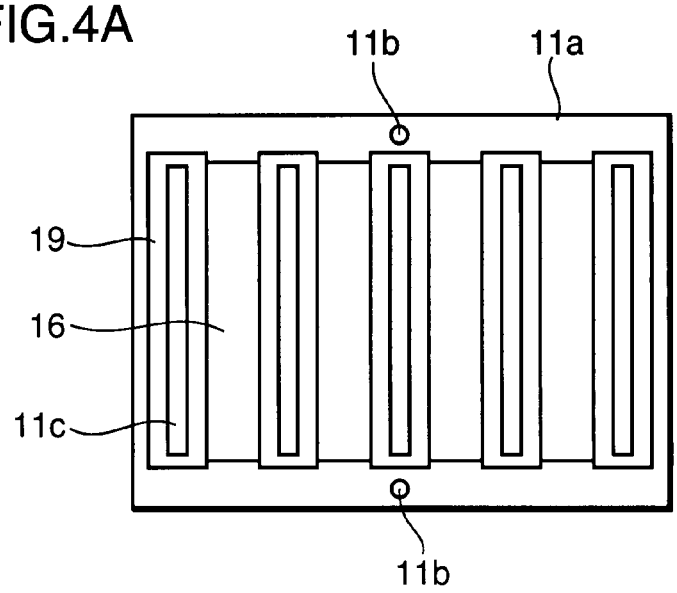
FIGS. 4A through 4D are manufacturing process diagrams showing the method for manufacturing the chip resistor in the first embodiment.

Next, as shown in FIG. 4A, second upper surface electrodes 19 are formed on a part of the upper surface of the sheet-like substrate 11*a* and the wall surfaces of the first slit grooves 11*c*, by performing sputtering, which is a thin film formation technique, with respect to the upper surface of the sheet-like substrate 11*a*, in a state that portions on the upper surface of the sheet-like substrate 11*a* corresponding to the portions between the first slit grooves 11*c* are masked by a metal mask (not shown). Similarly to the lower surface electrodes 17, the second upper surface electrodes 19 has a double-layer structure with a first layer made of chromium and a second layer made of copper-nickel alloy. Portions of the second upper surface electrodes 19 corresponding to the wall surfaces of the first slit grooves 11*c* are electrically connected to the portions of the lower surface electrodes 17 which constitute the end surface electrodes 18. The second upper surface electrodes 19 are formed on the upper surface of the sheet-like substrate 11*a* in such a manner as to cover the exposed portions of the first upper surface electrodes 12 and parts of the protective films 16.

The order of forming the lower surface electrodes 17 shown in FIG. 3C and the second upper surface electrodes 19 shown in FIG. 4A is not limited to the one shown in the first embodiment of the invention. If the reverse order is applied, in other words, if the second upper surface electrodes 19 shown in FIG. 4A are formed, followed by formation of the lower surface electrodes 17 shown in FIG. 3C, there is no particular drawback. Each of the lower surface electrodes 17 and the second upper surface electrodes 19 has a double-layer structure with the first layer made of chromium and the second layer made of copper-nickel alloy. Alternatively, both of the lower surface electrodes 17 and the second upper surface electrodes 19 may have a single-layer structure of nickel-chromium alloy.

Figure 4B:
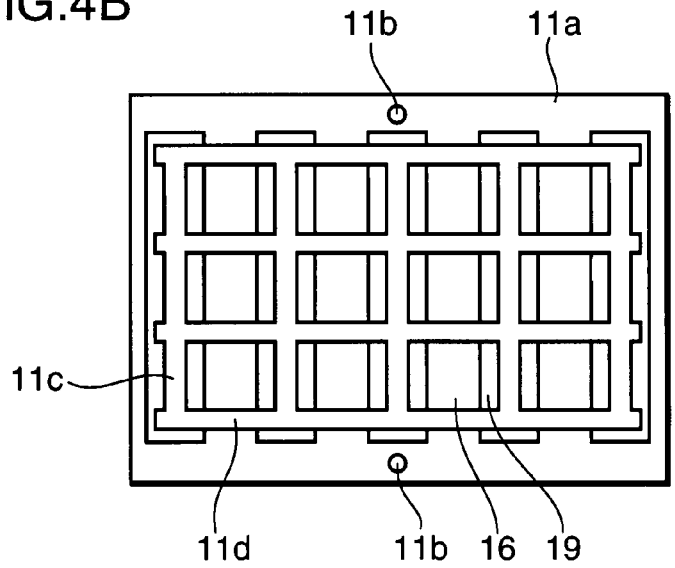

Next, as shown in FIG. 4B, the sheet-like substrate 11*a* is attached to a UV tape (not shown), with the surface having the first upper surface electrodes 12 being faced upward. Then, second slit grooves 11*d* are formed in the sheet-like substrate 11*a*, without cutting the resistive elements 13, in a direction parallel to the arrayed direction of the resistive elements 13 and the first upper surface electrodes 12, by a dicing technique using a high-speed rotating blade, with the positioning marks 11*b* being used as a reference. By the formation of the second slit grooves 11*d*, the sheet-like substrate 11*a* is formed into a certain number of substrates 11.

Figure 4C:
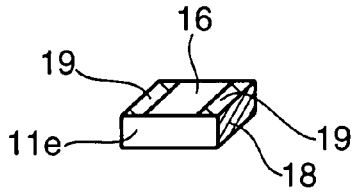

Next, the substrates 11, which are cut out of the sheet-like substrate 11*a* by the formation of the first slit grooves 11*c* and the second slit grooves 11*d*, are peeled off from the UV tape (not shown), and a chip resistor body 11*e* as a substrate piece as shown in FIG. 4C is obtained.

Figure 4D:
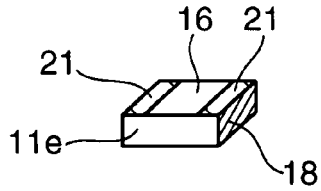

Lastly, as shown in FIG. 4D, the first plated layer 20 made of nickel, and the second plated layer 21 made of tin are formed by applying plating on the surfaces of the second upper surface electrodes 19, the surfaces of the end surface electrodes 18, and the surfaces of the lower surface electrodes 17 of the chip resistor body 11*e* by barrel plating. Thus, the chip resistor as shown in FIG. 1 is produced.

The first embodiment of the invention describes the arrangement that the first upper surface electrode 12 and the second upper surface electrode 19 constitute the upper surface electrode. Alternatively, the upper surface electrode may be constituted solely of the first upper surface electrode 12.

In the first embodiment, the resistive element 13 is covered by the two layers i.e. the glass layer 14 and the protective layer 16. Alternatively, the resistive element 13 may be covered solely by the protective film 16, without formation of the glass layer 14.

In the first embodiment, the first plated layer 20 is made of nickel. As far as the first plated layer 20 is made of a material with a large hardness, and serves as barrier layer in solder mounting, substantially the same effect as mentioned above can be expected. For instance, the first plated layer 20 may be made of copper having Mohs hardness of 3.0, or may be a composite layer including a copper plated layer and a nickel plated layer, or a composite layer including a nickel plated layer and a copper plated layer.

In the first embodiment, the second plated layer 21 is formed by tin plating. As far as the second plated layer 21 is made of a material having desirable solder wettability, substantially the same effect as mentioned above can be expected. For instance, the second plated layer 21 may be made of e.g. a solder (tin-lead alloy) or gold.

Second Embodiment

Figure 6:
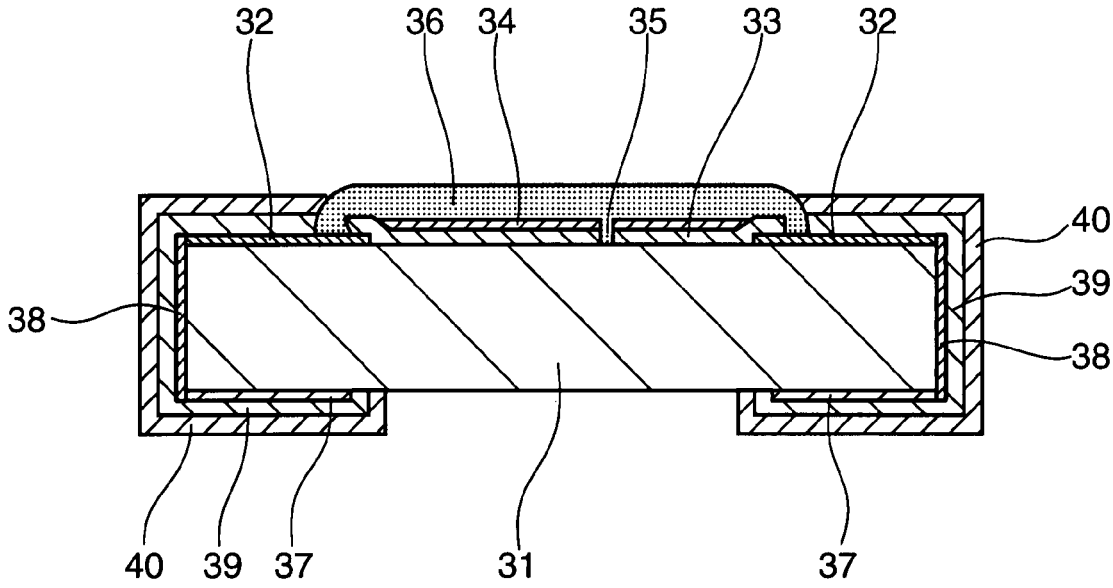
FIG. 6 is a cross-sectional view of a chip resistor, as an example of a chip-shaped electronic part according to a second embodiment of the invention.

FIG. 6 is a cross-sectional view showing a chip resistor, as an example of a chip-shaped electronic part according to the second embodiment of the invention. A substrate 31 is made of ceramics such as fired alumina, and has an insulation property. The thickness of the substrate 31 is decreased, as the size of the chip-shaped electronic part is decreased. For instance, a substrate 31 of a 0603 chip resistor with the outer dimensions of 0.6 mm×0.3 mm has a standard thickness of 0.2 mm, and a substrate 31 of a 0402 chip resistor with the outer dimensions of 0.4 mm×0.2 mm has a standard thickness of 0.1 mm.

A pair of upper surface electrodes 32 are formed at widthwise both ends on an upper surface of the substrate 31. The upper surface electrode pair 32 is made of a gold resinate paste containing gold, and has a thickness of about 1 μm. A ruthenium-oxide-based resistive element 33 is formed on the upper surface of the substrate 31 in such a manner that both ends thereof are placed over the upper surface electrode pair 32. The resistive element 33 has a thickness from 3 μm to 5 μm. A pre-coat glass layer 34 is formed in such a manner as to cover at least a part of the resistive element 33. The pre-coat glass layer 34 has a thickness of about 2 μm. A trimming groove 35 is formed in the resistive element 33 and in the pre-coat glass layer 34 to adjust the resistance of the resistive element 33 to an intended value.

A protective film 36 containing an epoxy resin as a main component is formed in such a manner as to cover the resistive element 33. The protective film 36 is formed in such a manner that the widthwise both ends thereof are placed over the upper surface electrode pair 32. The thickness of a portion of the protective film 36 above the resistive element 33 is from about 4 to 7 μm, which is smaller than the thickness of a conventional chip resistor.

Normally, in the case where the protective film 36 is made of a resin material, the protective film 36 has an upwardly convex portion with respect to a middle portion thereof including its vicinity resulting from a surface tension of the resin material. This tendency is increased, as the width of the protective film 36 is decreased, and as the thickness of the protective film 36 is increased. In particular, a small-sized chip resistor may likely to have an upwardly convex portion with respect to a middle portion of the protective film 36. However, in the second embodiment of the invention, the thickness of the portion of the protective film 36 above the resistive element 33 is at most as large as 7 μm, which is very small. This enables to form the upper surface of the protective film 36 into a substantially flat shape, without formation of an upwardly convex portion with respect to the middle portion of the protective film 36. The protective film 36 is formed in the longitudinal direction of the substrate 31 i.e. a direction perpendicular to the plane of FIG. 6, while keeping the cross-sectional shape as shown in FIG. 6. The substantially flat upper surface of the protective film 36 has a substantially rectangular shape in plan view.

A pair of lower surface electrodes 37 are formed on a lower surface of the substrate 31 at positions opposing the upper surface electrode pair 32. The lower surface electrode pair 37 is made of a silver-based material with a large thickness. Widthwise both ends on the substantially flat surface of the protective film 36 are formed above the lower surface electrode pair 37.

A pair of end surface electrodes 38 are formed on end surfaces of the substrate 31 in such a manner as to be electrically connected to the upper surface electrode pair 32 and to the lower surface electrode pair 37. The end surface electrode pair 38 is made of a silver-based conductive resin material.

The exposed portions of the surfaces of the upper surface electrode pair 32, the surfaces of the end surface electrode pair 38, and of the surfaces of the lower surface electrode pair 37 are covered by a pair of first plated layers 39. The first plated layer pair 39 is made of nickel. The surfaces of the first plated layer pair 39 are covered by a pair of second plated layers 40. The second plated layer pair 40 is made of tin. The thicknesses of the first plated layer 39 and the second plated layer 40 respectively lie in the range from 3 μm to 10 μm, and are set smaller than the height from the upper surface of the substrate 31 to the upper surface of the protective film 36 i.e. from 10 μm to 14 μm in the case where the height from the upper surface of the substrate 31 to the upper surface of the second plated layer 40 is in the range from 7 μm to 12 μm. In other words, the protective film 36 protrudes upwardly from a plated layer structure constituted of the first plated layer 39 and the second plated layer 40, and the upper surface of the protective film 36 comes into contact with a mounting nozzle in mounting the chip resistor. Thereby, a pressing force of the mounting nozzle is exerted on the upper surface of the protective film 36 in mounting. Thus, multitudes of points of application at which a load from above is exerted on the upper surface of the protective film 36 are provided in mounting the chip resistor.

In the following, a method for manufacturing the chip resistor, as an example of the chip-shaped electronic part according to the second embodiment of the invention is described referring to the drawings.

FIGS. 7A through 7C, and 8A through 8D are manufacturing process diagrams showing the method for manufacturing the chip resistor, as an example of the chip-shaped electronic part according to the second embodiment of the invention.

Figure 7A:
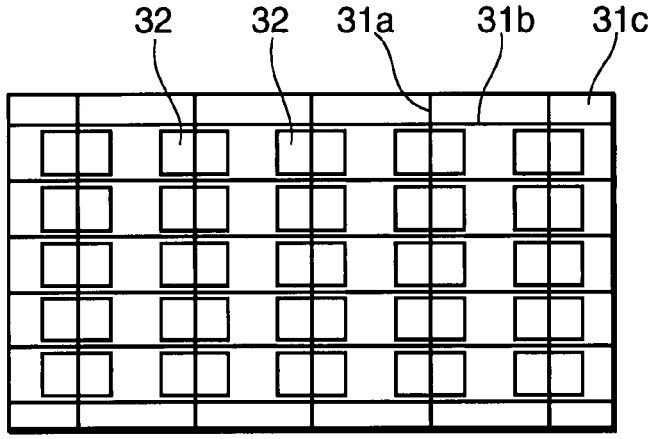
FIGS. 7A through 7C are manufacturing process diagrams showing a method for manufacturing the chip resistor in the second embodiment.

First, as shown in FIG. 7A, prepared is a sheet-like substrate 31*c* made of ceramics such as fired alumina and having an insulation property, in which first dividing grooves 31*a* and second dividing grooves 31*b* are formed in each of an upper surface and a lower surface of the sheet-like substrate 31*c*. A number of upper surface electrodes 32 are formed in a grid pattern by screen printing a gold resinate paste containing gold on the upper surface of the sheet-like substrate 31*c* in such a manner as to bridge over the first dividing grooves 31*a*, and by firing the sheet-like substrate 31*c*, using a firing profile with a peak temperature of 850° C. Although not illustrated, a number of lower surface electrodes 37 (not shown) are formed on the lower surface of the sheet-like substrate 31*c* in such a manner as to bridge over the first dividing grooves 31*a* by screen printing a silver electrode paste, using a firing profile with a peak temperature of 850° C.

Figure 7B:
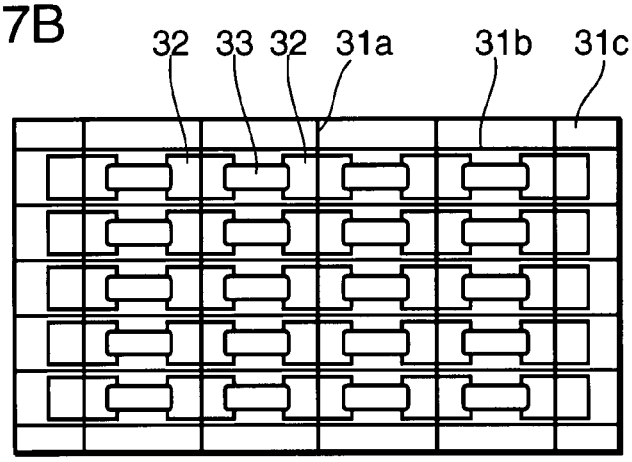

Next, as shown in FIG. 7B, resistive elements 33 are formed on the upper surface of the sheet-like substrate 31*c* by screen printing a ruthenium-oxide-based resistive paste in such a manner as to partly cover the upper surface electrodes 32, using a firing profile with a peak temperature of 850° C.

Figure 7C:
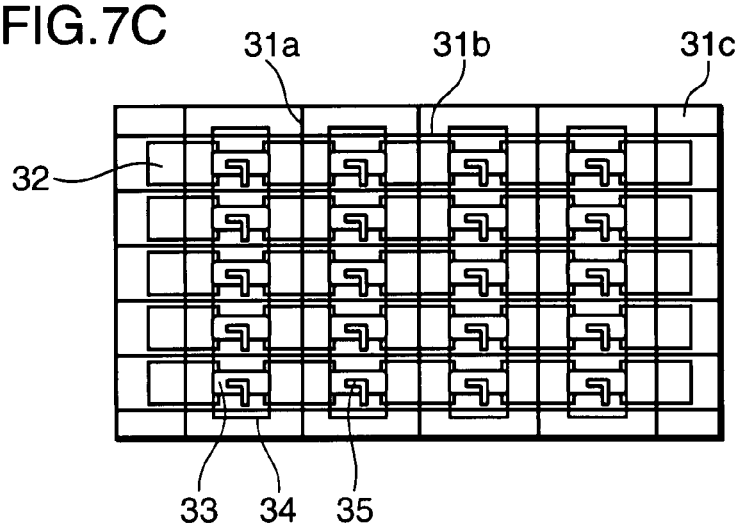

Next, as shown in FIG. 7C, pre-coat glass layers 34 made of lead borate silicate are formed on the upper surface of the sheet-like substrate 31*c* by a screen printing method in such a manner as to cover the resistive elements 33 between the upper surface electrodes 32. Thereafter, the sheet-like substrate 31*c* is fired, using a firing profile with a peak temperature of 600° C., to form the pre-coat glass layers 34 into stable films. Also, trimming grooves 35 are formed in the resistive elements 33 through the pre-coat glass layers 34 by a laser trimming technique, while measuring a resistance of the respective resistive elements 33 between the upper surface electrodes 32 to adjust the resistance of the respective resistive elements 33 to an intended value.

Figure 8A:
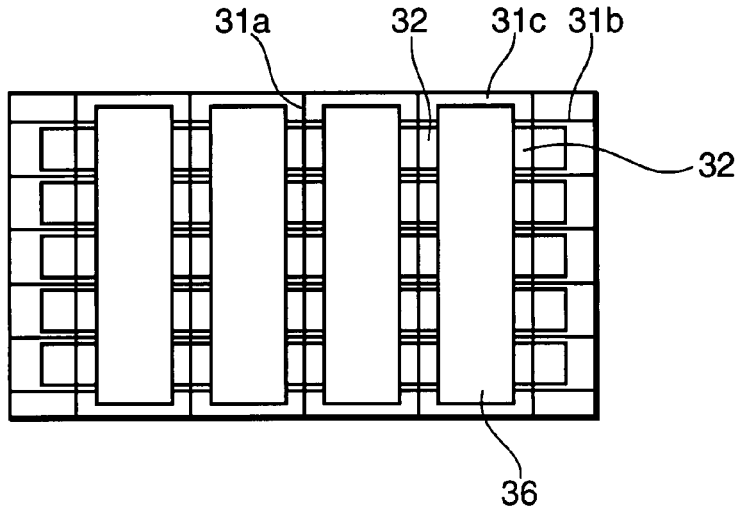
FIGS. 8A through 8D are manufacturing process diagrams showing the method for manufacturing the chip resistor in the second embodiment.

Next, as shown in FIG. 8A, protective films 36 containing an epoxy resin as a main component are formed by a screen printing method in such a manner as to cover the resistive elements 33. Thereafter, the sheet-like substrate 31*c* is cured, using a curing profile with a peak temperature of 200° C., to form the protective films 36 into stable films.

Figure 8B:
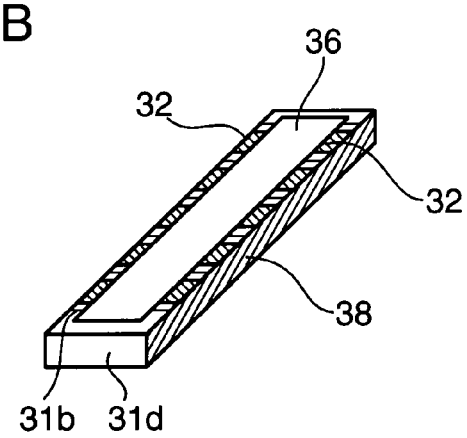

Next, a strip-shaped substrate 31*d* as shown in FIG. 8B is formed by dividing the sheet-like substrate 31*c* along the first dividing grooves 31*a* shown in FIG. 8A. Also, end surface electrodes 38 are formed on end surfaces of the strip-shaped substrate 31*d* by coating a conductive resin electrode for curing in such a manner as to be electrically connected to the upper surface electrodes 32 and to the lower surface electrodes 37.

Figure 8C:
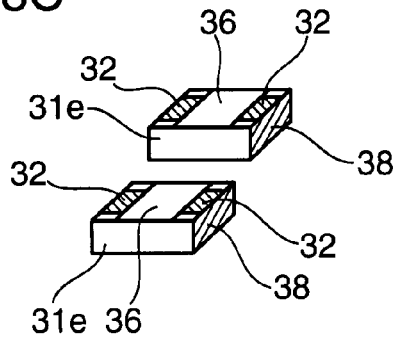
Figure 8D:
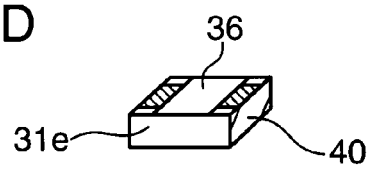

Next, pieces of substrates 31*c* as shown in FIG. 8C are formed by dividing the strip-shaped substrate 31*d* shown in FIG. 8B along the second dividing grooves 31*b*.

Lastly, the first plated layers 39 made of nickel, and the second plated layers 40 made of tin are formed by applying plating onto parts of the surfaces of the upper surface electrodes 32, the surfaces of the lower surface electrodes 37, and the surfaces of the end surface electrodes 38 by barrel plating. Thus, the chip resistor as shown in FIG. 6 is produced.

In the second embodiment of the invention, the thickness of the resistive element 33 is from 3 μm to 5 μm, the thickness of the pre-coat glass layer 34 is 2 μm, and the total thickness of the resistive element 33 and the pre-coat glass layer 34 is from 5 μm to 7 μm, all of which are very small. This arrangement enables to suppress the depth of the trimming groove 35 i.e. the total thickness of the resistive element 33 and the pre-coat glass layer 34 as much as possible. With this arrangement, the trimming groove 35 can be completely covered by the protective film 36 despite the use of the thin protective film 36, which eliminates lowering of environmental resistance.

Figure 9:
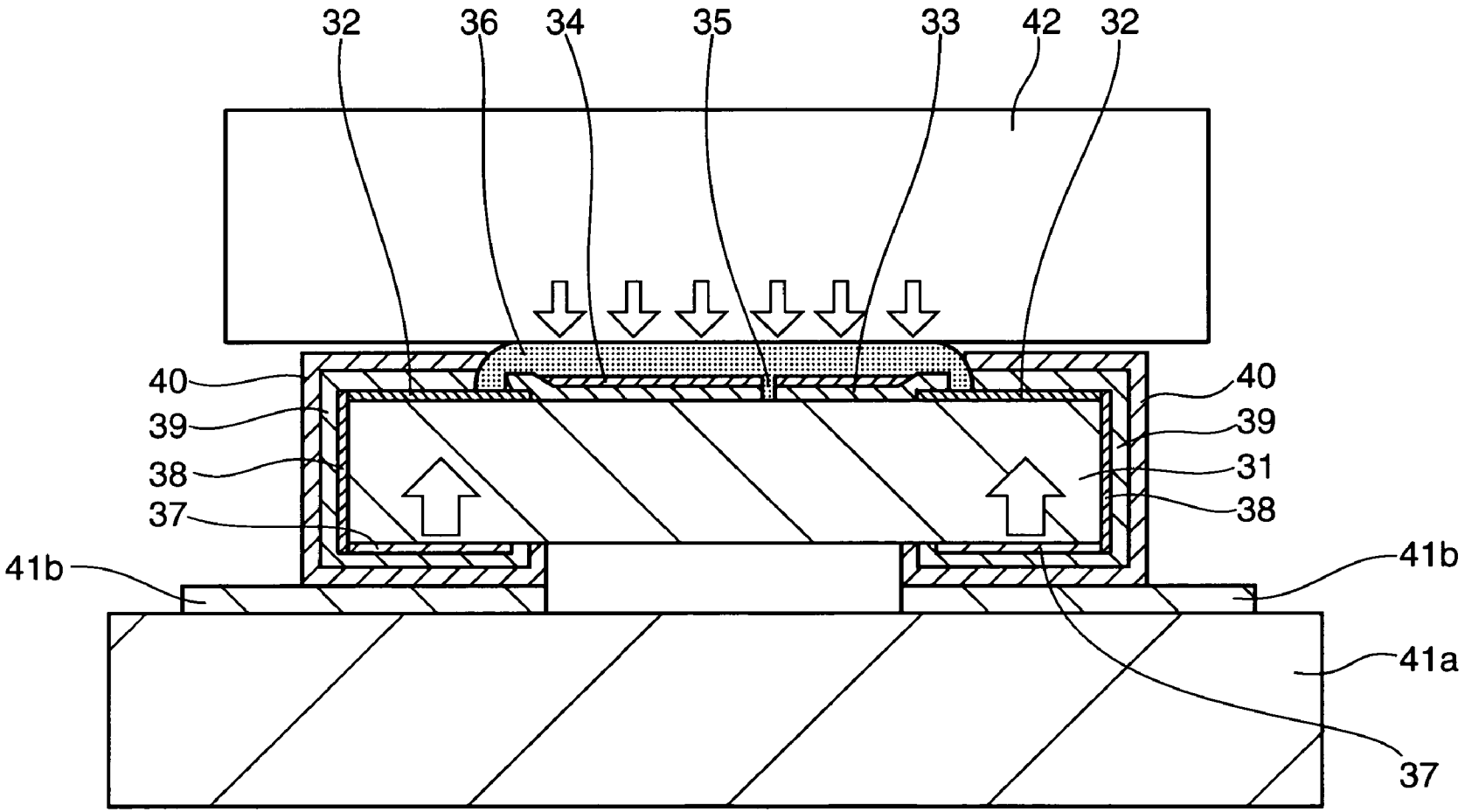
FIG. 9 is an elevational cross-sectional view showing a state that the chip resistor, with a protective film in close contact with a mounting nozzle, is mounted on a printed circuit board of an electronic device.

Also, as shown in FIG. 9, in the case where a small-sized chip resistor with a very thin substrate such as a 0603 chip resistor with the outer dimensions of 0.6 mm×0.3 mm, or a 0402 chip resistor with the outer dimensions of 0.4 mm×0.2 mm is mounted on electrode lands 41*b* of a printed circuit board 41*a* of an electronic device with use of a mounting nozzle 42, a pressing force of the mounting nozzle 42 is exerted on the protective film 36 corresponding to a highest portion of the upper surface of the chip resistor. The pressing force exerted on the protective film 36, and a repulsive force received on the lower surface electrode pair 37 as protrusions on the lower surface of the chip resistor act as a force to bend the substrate 31. In the second embodiment of the invention, however, the upper surface of the protective film 36 is made substantially flat by setting the thickness of the portion of the protective film 36 above the resistive element 33 to about 4 to 7 μm, which is smaller as compared with a conventional chip resistor. Accordingly, in the second embodiment, the pressing force of the mounting nozzle 42 is distributed substantially over the entire surface of the upper surface of the protective film 36, unlike the conventional chip resistor, in which the pressing force of the mounting nozzle 42 is intensively exerted on the middle portion of the protective film 36, even if the pressing force of the mounting nozzle 42 is exerted on the protective film 36. This reduces a bending stress to be exerted on the substrate 31, thereby causing no or less crack of the substrate 31, as compared with the conventional chip resistor.

Table 2 shows thicknesses of the portions of the protective films 36 above the resistive elements 33, and load values (averages) at which the substrates 31 are cracked.

TABLE 2

| thickness of portion of protective film above resistive element | load value at which substrate is cracked (average) |
|---|---|
| 3 μm to 5 μm | 12.2N |
| 4 μm to 7 μm | 11.5N |
| 8 μm to 12 μm | 5.1N |

As is obvious from Table 2, if the protective film 36 has a thickness equal to or smaller than 7 μm, a load value at which the substrate 31 is cracked is considerably large, as compared with the chip resistor with the protective film thickness from 8 μm to 12 μm. This shows that crack of the substrate 31 is less likely to occur, if the protective film 36 has a thickness equal to or smaller than 7 μm. Table 2 also shows that if the protective film 36 has a thickness equal to or smaller than 7 μm, the surface of the protective film 36 is made substantially flat.

If the depth of the trimming groove 35 i.e. the total thickness of the resistive element 33 and the pre-coat glass layer 34 exceeds a value twice as large as the thickness of the protective film 36, the trimming groove 35 cannot be completely filled by the protective film 36, which may result in partial exposure of the resistive element 33. This may cause lowering of environmental resistance. In view of this, it is necessary to set the total thickness of the resistive element 33 and the pre-coat layer 34 twice as large as the thickness of the protective film 36 or less, if the trimming groove 35 is formed, and the thickness of the protective film 36 is reduced. Since the lower limit of the thickness of the protective film 36 is 4 μm, it is necessary to set the total thickness of the resistive element 33 and the pre-coat glass layer 34 to 8 μm or less.

Also, if the thickness of the protective film 36 is 3 μm or less, a cushion effect against application of an impact load is reduced, which may likely cause tearing of the protective film 36. Accordingly, it is desirable to set the thickness of the protective film 36 in the range of not smaller 4 μm and not larger than 7 μm.

In the case where the trimming groove 35 is not formed, even if the total thickness of the resistive element 33 and the pre-coat glass layer 34 is twice as large as the thickness of the protective film 36 or more, there is no particular drawback concerning product reliability. However, precision in resistance is extremely degraded, which may cause an adverse effect to a yield of products.

The second embodiment of the invention describes the arrangement that the upper surface of the protective film 36 is made substantially flat by setting the thickness of the portion of the protective film 36 above the resistive element 33 to 7 μm or less. Alternatively, the upper surface of the protective film 36 may be made substantially flat by a process other than the above such as grinding. In the altered arrangement, the effect of the invention can be effectively obtained by setting a distance of the flat portion on the upper surface of the protective film 36 with respect to a direction in which the lower surface electrodes 37 in pair are away from each other i.e. a widthwise direction in FIG. 6, in other words, a distance between the outermost points of application among the multitudes of points of application at which a load from above is exerted on the upper surface of the protective film 36 to one-half or more of a distance between the opposing end portions of the lower surface electrode pair 37. However, setting the widthwise both ends of the substantially flat upper surface of the protective film 36 above the lower surface electrode pair 37, as shown in FIG. 6, enables to effectively reduce a bending stress to be exerted on the substrate 31, which is further advantageous in obtaining the effect of the invention.

The second embodiment of the invention describes the arrangement that the resistive element 33 is covered by the two layers i.e. the pre-coat glass layer 34 and the protective film 36. Alternatively, solely the protective film 36 may cover the resistive element 33, without forming the pre-coat glass layer 34. In the altered arrangement, if the trimming groove 35 is formed in the resistive element 33, it is preferred to set the thickness of the resistive element 33 twice as large as the thickness of the protective film 36 or less.

In the second embodiment, the resistive elements 33 and the protective films 36 are formed by a screen printing method. Alternatively, the resistive elements 33 and the protective films 36 may be formed by a thin film formation technique such as sputtering. In the altered arrangement, very thin resistive elements 33 can be formed, which contributes to improved flatness concerning the surface of the protective films 36.

In the second embodiment, the end surface electrodes 38 are formed by coating a conductive resin electrode. Alternatively, the end surface electrodes 38 may be formed by a thin film formation technique such as sputtering.

Also, it is possible to adopt the manufacturing method shown in the first embodiment of the invention, as the manufacturing method of the chip resistor according to the second embodiment of the invention. Conversely, it is possible to adopt the manufacturing method shown in the second embodiment of the invention, as the manufacturing method of the chip resistor according to the first embodiment of the invention.

Third Embodiment

Figure 10:
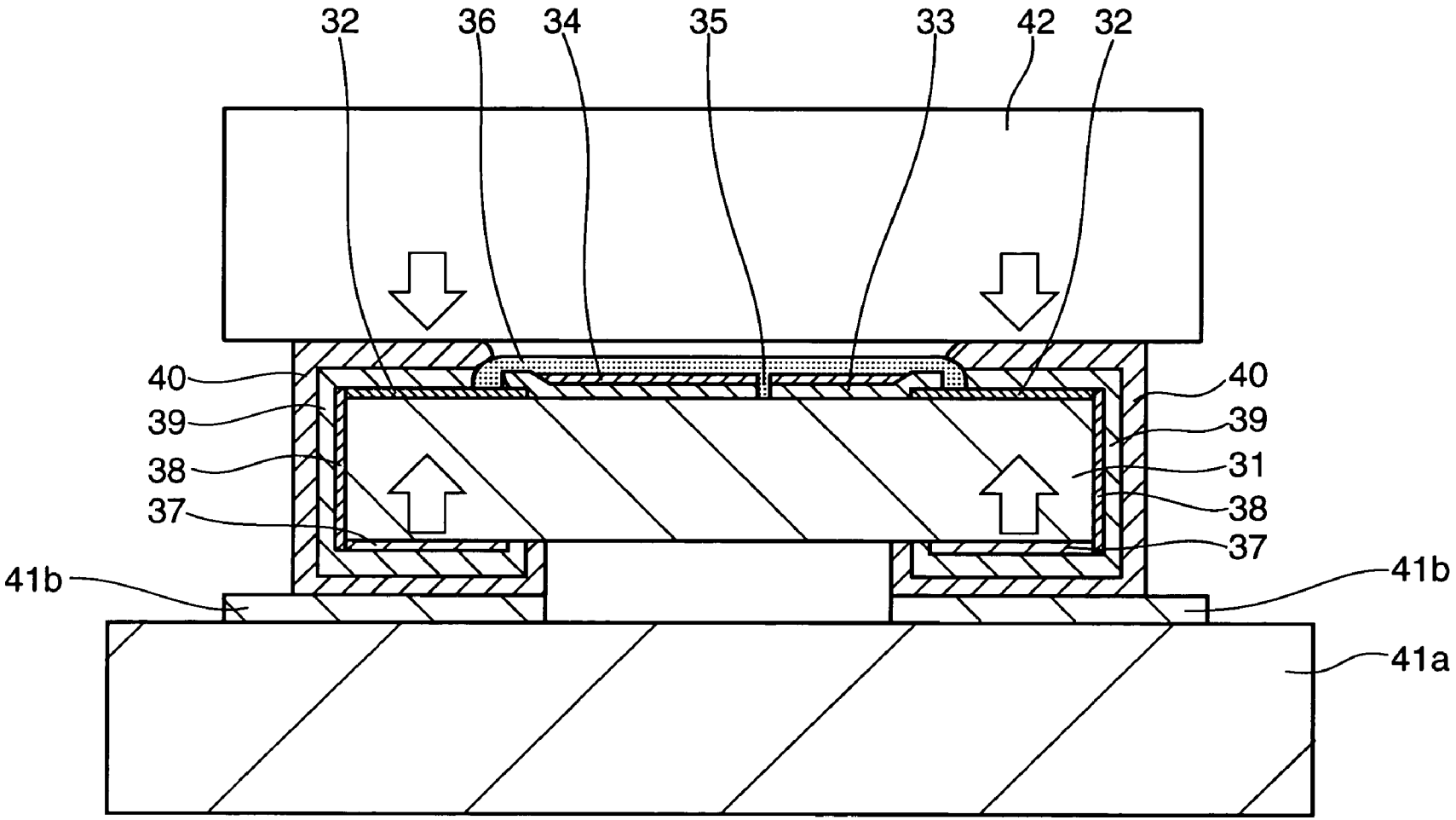
FIG. 10 is a cross-sectional view of a chip resistor, as an example of a chip-shaped electronic part according to a third embodiment of the invention.
Figure 11:
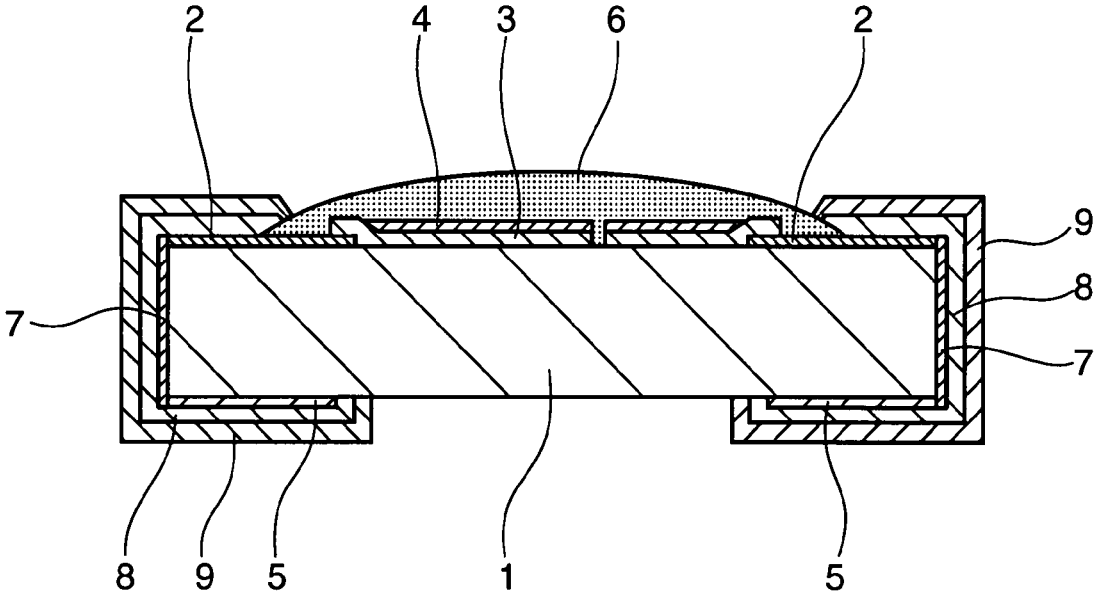
FIG. 11 is a cross-sectional view of a chip resistor, as an example of a conventional chip-shaped electronic part.
Figure 12A:
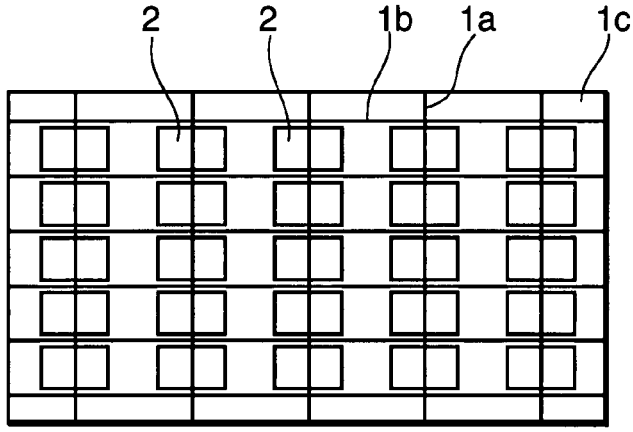
FIGS. 12A through 12C are manufacturing process diagrams showing a method for manufacturing the conventional chip resistor.
Figure 12B:
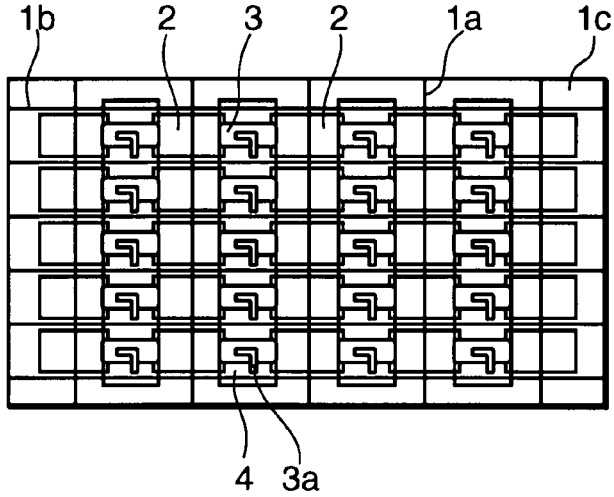
Figure 12C:
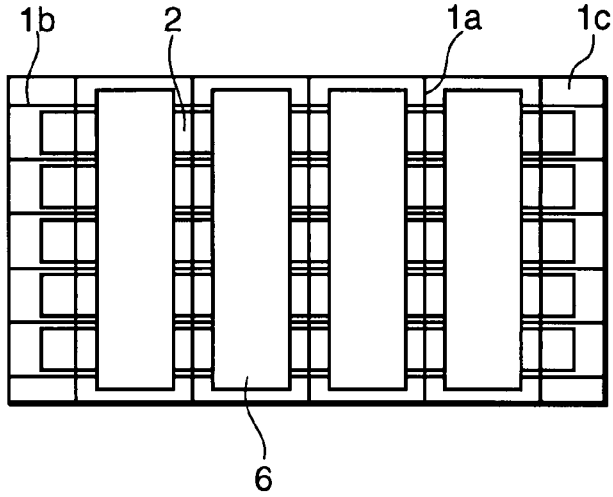
Figure 13A:
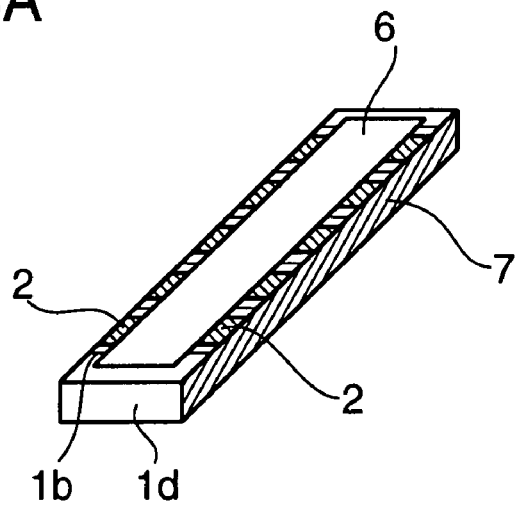
FIGS. 13A through 13C are manufacturing process diagrams showing the method for manufacturing the conventional chip resistor.
Figure 13B:
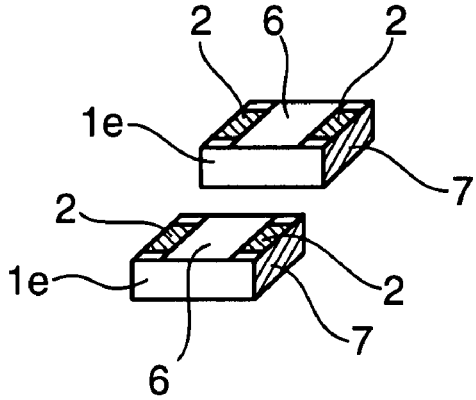
Figure 13C:
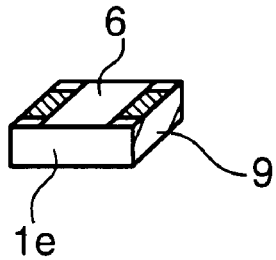
Figure 14:
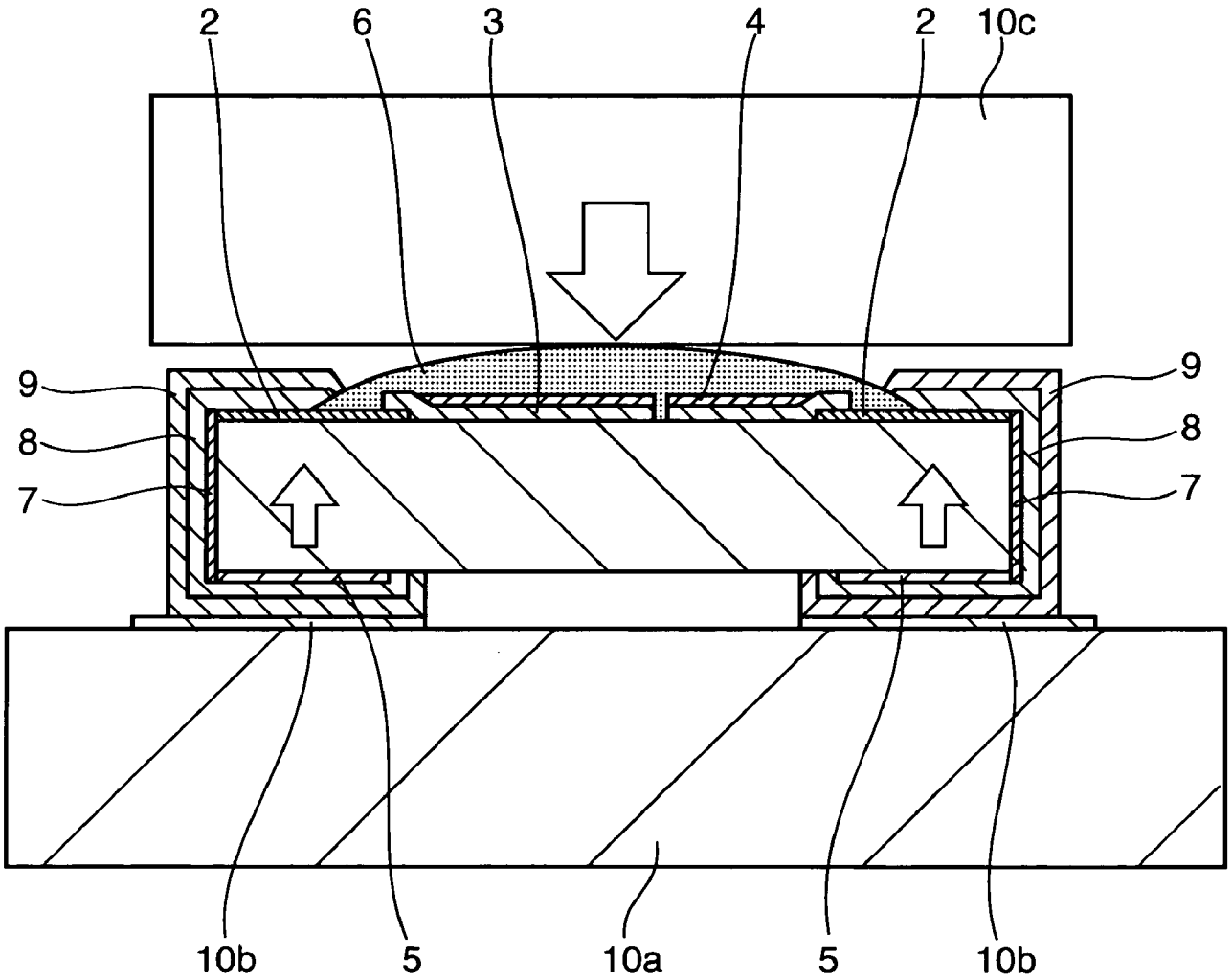
FIG. 14 is an elevational cross-sectional view showing a state that the conventional chip resistor is mounted on a printed circuit board of an electronic device.
Figure 15:
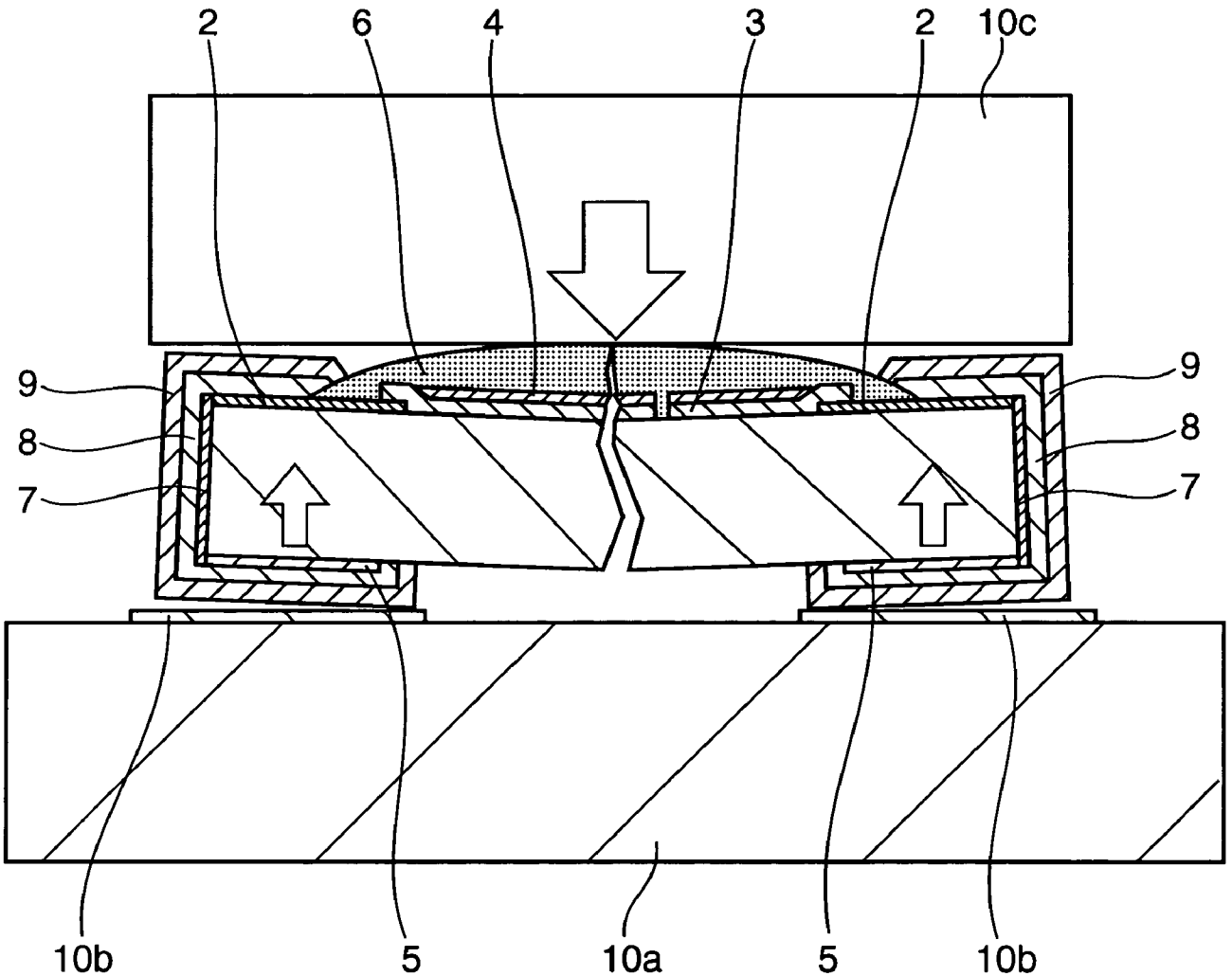
FIG. 15 is an elevational cross-sectional view showing a state that a substrate is cracked when the conventional chip resistor is mounted on a printed circuit board of an electronic device.

FIG. 10 is a cross-sectional view showing a chip resistor, as an example of a chip-shaped electronic part according to the third embodiment of the invention. The third embodiment is a combination of the second embodiment and a modification of the first embodiment. Elements in the third embodiment identical or equivalent to those in the second embodiment are denoted at the same reference numerals as the second embodiment.

Specifically, an upper surface of a protective film 36 is made substantially flat by setting the thickness of a portion of the protective film 36 above a resistive element 33 to 7 μm or less. Also, the thicknesses of a first plated layer 39 and a second plated layer 40 are set so that the height from the upper surface 31 to the upper surface of the second plated layer 40 is in the range from 12 μm to 21 μm, and is larger than the height from the upper surface of the substrate 31 to the upper surface of the protective film 36 i.e. from 10 μm to 14 μm; and that a plated layer structure constituted of the first plated layer 39 and the second plated layer 40 protrudes upwardly from the protective film 36. The upper surface of the second plated layer 40 is made substantially flat.

Taking an advantage of the arrangement that the thickness of the portion of the protective film 36 above the resistive element 33 is small, the height of the second plated layer 40 can be easily made larger than that of the protective film 36 by slightly increasing the thickness of the second plated layer 40. Specifically, it is preferred to increase the thicknesses of the upper surface electrode 32, the first plated layer 39, or the second plated layer 40 by about 4 μm in total. In the preferred arrangement, as shown in FIG. 10, a pressing force to be exerted on the second plated layer 40, and a repulsive force received on a lower surface electrode pair 37 as protrusions on the lower surface of the chip resistor are applied substantially at the same positions. Accordingly, the arrangement as shown in FIG. 10 is more preferred, because the arrangement eliminates application of a force to bend the substrate 31, and eliminates or suppresses a substrate crack.

As described above, making the upper surface of the second plated layer 40 substantially flat enables to distribute the pressing force of the mounting nozzle over the upper surface of the second plated layer 40. This is advantageous in reducing a deformation amount of the second plated layer 40.

The above embodiments of the invention describe the chip resistors, as examples of the chip-shaped electronic part. The invention is applicable to a chip-shaped electronic part other than the chip resistor.

As described above, a chip-shaped electronic part of the invention comprises a substrate; a pair of upper surface electrodes formed on an upper surface of the substrate; a functional element formed to be electrically connected to the upper surface electrode pair; a pair of lower surface electrodes formed on a lower surface of the substrate at positions opposing the upper surface electrode pair; a pair of end surface electrodes formed on end surfaces of the substrate so that each of the end surface electrode pair is electrically connected to one of the upper surface electrode pair, and to one of the lower surface electrode pair corresponding to the one upper surface electrode; a protective film formed in such a manner as to cover at least the functional element; and a plated layer formed in such a manner as to cover at least each of the upper surface electrode pair, wherein the protective film or the plated layer has at least two points of application at which a load from above the substrate is exerted.

In the above arrangement, in the case where the chip-shaped electronic part is mounted on a printed circuit board of an electronic device by suction with use of a mounting nozzle, a pressing force of the mounting nozzle is distributed to at least the two points of application. Accordingly, a bending stress to be exerted to the substrate is reduced, which causes no or less substrate crack.

Preferably, in the chip-shaped electronic part, with respect to a direction in which the lower surface electrodes in pair are away from each other, a distance between outermost points of application among the at least two points of application at which the load is exerted may be set to one-half or more of a distance between opposing end portions of the lower surface electrode pair.

The above arrangement enables to advantageously obtain the effect of the invention.

Preferably, in the chip-shaped electronic part, the plated layer may have a protrusion which protrudes upwardly from the protective film, and the load may be exerted on the protrusion of the plated layer.

The above arrangement enables to exert the load on the plated layer.

Preferably, in the chip-shaped electronic part, the plated layer may have a substantially flat upper surface.

In the above arrangement, since the load is distributed over the upper surface of the plated layer, a deformation amount of the plated layer can be reduced.

Preferably, in the chip-shaped electronic part, the protrusion of the plated layer may be formed at a position above the lower surface electrode pair.

The above arrangement enables to save the material composing the plated layer and to eliminate or suppress a bending stress to be exerted on the substrate, which is further advantageous in preventing a substrate crack.

Preferably, in the chip-shaped electronic part, the plated layer may include a first plated layer for covering at least the each of the upper surface electrode pair, and a second plated layer for covering the first plated layer, the second plated layer having a smaller hardness than a hardness of the first plated layer, and being softer than the first plated layer, and the first plated layer has a thickness larger than a thickness of the second plated layer.

In the above arrangement, since an influence of deformation of the second plated layer can be suppressed, the effect of preventing a substrate crack can be increased.

Preferably, in the chip-shaped electronic part, the first plated layer may protrude upwardly from the protective film.

In the above arrangement, even if the second plated layer which has a smaller hardness and is soft is deformed, the first plated layer can receive the pressing force of the mounting nozzle.

Preferably, in the chip-shaped electronic part, the thickness of the first plated layer may be set in a range from 10 μm±1 μm, and the thickness of the second plated layer may be set in a range from 6 μm±1 μm.

The above arrangement enables to effectively suppress a substrate crack while suppressing the production cost.

Preferably, in the chip-shaped electronic part, the thickness of the first plated layer may be set in a range from 10 μm±4 μm, and the thickness of the second plated layer may be set in a range from 6 μm±3 μm, considering variation in a manufacturing step.

Preferably, in the chip-shaped electronic part, the protective film may protrude upwardly from the plated layer, and may have a substantially flat upper surface, and the load may be exerted on the substantially upper surface of the protective film.

The above arrangement enables to exert the load on the protective film.

Preferably, in the chip-shaped electronic part, a thickness of a portion of the protective film above the functional element may be set to 7 μm or smaller.

In the above arrangement, the upper surface of the protective film can be made substantially flat by setting the thickness of the protective film as mentioned above.

Preferably, in the chip-shaped electronic part, the thickness of the portion of the protective film above the functional element may be set to 4 μm or larger.

Preferably, in the chip-shaped electronic part, opposing end portions on the substantially flat upper surface of the protective film with respect to a direction in which the lower surface electrodes in pair are away from each other may be formed above the lower surface electrode pair.

In the above arrangement, since the bending stress to be exerted on the substrate can be effectively reduced, the effect of the invention can be further advantageously obtained.

Preferably, in the chip-shaped electronic part, the functional element may be a resistive element, and the resistive element may have a thickness twice as large as a thickness of the protective film or less.

In the above arrangement, in the case where a trimming groove is formed in the resistive element, the trimming groove can be completely filled by the protective film. This enables to prevent partial exposure of the resistive element from the protective film.

Preferably, in the chip-shaped electronic part, the resistive element may be covered by the protective film via a pre-coat glass layer, and the sum of the thickness of the resistive element and a thickness of the pre-coat glass layer may be set to twice as large as the thickness of the protective film or less.

In the above arrangement, even if the trimming groove is formed in the resistive element covered by the pre-coat glass layer, the trimming groove can be completely filled by the protective film. This enables to prevent partial exposure of the resistive element from the protective film.

Preferably, in the chip-shaped electronic part, the plated layer may include a first plated layer for covering at least the each of the upper surface electrode pair, and a second plated layer for covering the first plated layer, and the first plated layer may be one of a nickel plated layer, a copper plated layer, a composite layer including the nickel plated layer and the copper plated layer, and a composite layer including the copper plated layer and the nickel plated layer.

In the above arrangement, in mounting the chip-shaped electronic part on a printed circuit board by solder mounting, using a low melting point metal such as tin-lead alloy or tin-silver-copper alloy, there is no likelihood that the first plated layer may be fused into an alloy. Thus, the first plated layer serves as a barrier layer for preventing fusion of the lower surface electrode or the end surface electrode with the low melting point metal, which enhances connection reliability.

Preferably, in the chip-shaped electronic part, the second plated layer may be one of a tin plated layer, a solder plated layer, and a gold plated layer.

In the above arrangement, in mounting the chip-shaped electronic part on a printed circuit board by solder mounting, the second plated layer and a low melting point metal are easily fused. This enables to prevent failure in solder wettability.

Preferably, the chip-shaped electronic part according to the invention may be a chip resistor.

In the above arrangement, the invention can be applied to the chip resistor.

EXPLOITATION IN INDUSTRY

The inventive chip-shaped electronic part is advantageous in suppressing a substrate crack, and accordingly, particularly useful as a chip-shaped electronic part such as a small-sized chip resistor.

The invention claimed is:

1. A chip-shaped electronic part, comprising:

a substrate including an upper surface, a lower surface, and end surfaces;

a pair of upper surface electrodes formed on the upper surface of the substrate;

a functional element formed to be electrically connected to the pair of upper surface electrodes;

a pair of lower surface electrodes formed on the lower surface of the substrate at positions opposing the pair of upper surface electrodes;

a pair of end surface electrodes formed on the end surfaces, respectively, of the substrate so that each of the end surface electrodes is electrically connected to one of the upper surface electrodes, and to one of the lower surface electrodes corresponding to the one of the upper surface electrodes;

a protective film formed in such a manner as to cover at least the functional element; and a plated layer formed in such a manner as to cover at least each of the pair of upper surface electrodes, wherein the protective film or the plated layer has at least two points of application at which a load from above the substrate is exerted, wherein the plated layer includes a first plated layer for covering the at least each of the pair of upper surface electrodes, and a second plated layer for covering the first plated layer, the second plated layer having a smaller hardness than a hardness of the first plated layer such that the second plated layer is softer than the first plated layer, wherein the first plated layer has a thickness larger than a thickness of the second plated layer, wherein the thickness of the first plated layer is set in a range from 10 μm±4 μm and the thickness of the second plated layer is set in a range from 6 μm±3 μm, and wherein the first plated layer protrudes upwardly from the protective film.

2. The chip-shaped electronic part according to claim 1, wherein the thickness of the first plated layer is set in a range from 10 μm±1 μm, and the thickness of the second plated layer is set in a range from 6 μm±1 μm.

* * * * *